US007614098B1

(12) United States Patent
Quarry

(10) Patent No.: US 7,614,098 B1
(45) Date of Patent: Nov. 10, 2009

(54) SUPPORT SYSTEM WITH REPOSITIONABLE BOLSTERS

(76) Inventor: Veronica Quarry, 200 Swanton St., Apt. 434, Winchester, MA (US) 01890

( * ) Notice: Subject to any disclaimer, the term of this patent is extended or adjusted under 35 U.S.C. 154(b) by 0 days.

(21) Appl. No.: 12/358,023

(22) Filed: Jan. 22, 2009

(51) Int. Cl.
*A47C 27/00* (2006.01)
*A47G 9/00* (2006.01)

(52) U.S. Cl. ..... 5/111; 5/630; 5/638; 5/732; 5/652.1; 5/655; 5/724; 5/98.3; 5/691; 297/219.12; 297/284.9; 297/397; 297/467; 24/13; 24/457; 24/458; 24/306; 24/442; 24/707.7; 24/711.1

(58) Field of Classification Search ..... 5/111, 5/630, 638, 425, 732, 652.1, 655, 724, 98.3, 5/691; 297/219.12, 284.9, 397, 467; 24/13, 24/457, 458, 306, 442, 707.7, 711.1
See application file for complete search history.

(56) References Cited

U.S. PATENT DOCUMENTS

| | | | | |
|---|---|---|---|---|
| 4,291,917 | A | 9/1981 | Hawks | |
| 4,510,634 | A | 4/1985 | Diedrich et al. | |
| 4,516,806 | A | 5/1985 | McDonald et al. | |
| 4,934,997 | A | 6/1990 | Skakas | |
| 5,172,955 | A | 12/1992 | Freese et al. | |
| 5,216,772 | A | 6/1993 | Clute | |
| 5,272,780 | A | 12/1993 | Clute | |
| 5,367,730 | A | 11/1994 | Sher | |
| 5,561,876 | A * | 10/1996 | Petruzella | 5/724 |
| 5,566,407 | A | 10/1996 | Lien | |
| 5,586,351 | A | 12/1996 | Ive | |
| 5,588,445 | A | 12/1996 | Obaidi | |
| 5,632,052 | A | 5/1997 | Michel | |
| 5,699,571 | A * | 12/1997 | Yowell | 5/724 |
| 5,855,031 | A * | 1/1999 | Swift, Jr. | 5/93.1 |
| 5,868,459 | A | 2/1999 | Welsh, Jr. | |
| 6,036,263 | A | 3/2000 | Gold | |
| 6,052,849 | A | 4/2000 | Dixon et al. | |
| 6,065,166 | A | 5/2000 | Sharrock et al. | |
| 6,256,813 | B1 | 7/2001 | Aaron | |
| 6,272,705 | B1 * | 8/2001 | Jones | 5/691 |
| 6,438,775 | B1 | 8/2002 | Koenig | |
| 7,070,238 | B1 | 7/2006 | Alexander et al. | |
| 7,322,062 | B1 | 1/2008 | Matthews | |
| 2002/0002741 | A1 | 1/2002 | Tomas et al. | |
| 2005/0120484 | A1 | 6/2005 | Gold et al. | |

* cited by examiner

*Primary Examiner*—Alexander Grosz
(74) *Attorney, Agent, or Firm*—O'Connell Law Firm

(57) ABSTRACT

A support system with repositionable bolsters with a panel of material, which can comprise elastomeric mesh, and bolsters repositionably securable to the panel of material. The panel of material can be retained relative to a bed or other structure or by a frame, which can be foldable. The bolsters, which can be formed with a breathable mesh shell, can be secured to the panel of material by a plurality of extendable and retractable fingers for being received through apertures in the panel of elastomeric material, by at least one expansible structure for being received through the apertures in the panel of elastomeric material and expanded, or by pivotable arms adjustable between generally parallel and non-parallel dispositions. The support system can be used independently or incorporated within a crib, bassinet, car seat, high chair, swing, bouncing seat or support, or any other support structure.

22 Claims, 7 Drawing Sheets

SUPPORT SYSTEM WITH REPOSITIONABLE BOLSTERS

FIELD OF THE INVENTION

This invention relates generally to occupant support arrangements. More particularly, disclosed and protected herein is a support system with detachable and repositionable bolsters for facilitating safe and comfortable support for infants to promote healthy motor development while preventing infantile positional plagiocephaly and reducing the risk of sudden infant death syndrome and for providing necessary and appropriate positioning support to the physically challenged and other occupants of beds, seats, and further support arrangements.

BACKGROUND OF THE INVENTION

Newborn and premature infants typically lack the muscular strength necessary for retaining proper or desired head and torso positioning. Furthermore, many children are born each year with physical and developmental challenges that cause the child to require supplemental physical support for comfortable and physiologically sound positioning. Consequently, infants and children, adolescents, and even adults challenged with deficiencies in muscle tone and muscle control deriving from muscular and neuromuscular deficiencies, such as muscular dystrophy, muscular atrophy, and other maladies and genetic disorders, need head, torso, and other bodily support for proper positioning and to promote optimal motor and muscular development. Other, normally healthy individuals may experience periods of special needs for supported positioning, such as during pregnancy or recovery from injury or surgery.

Developmentally challenged children often need to be positioned and supported by a system that can be configured according to their specific needs. Of course, it is also important that a positioning and support system be able to be adjusted and reconfigured as the child grows and as his or her needs change. The ability to adjust and to be reconfigured allows a caregiver to ensure that the support and positioning is always appropriate for the child's stage of development and the status of his or her condition.

One knowledgeable in the art will also be aware that medical studies have shown that infants who sleep on their backs have a reduced risk of experiencing Sudden Infant Death Syndrome (SIDS) compared to infants who sleep on their stomachs. Consequently, parents have been encouraged by the American Academy of Pediatrics, the National Institute of Child Health and Human Development through the Back to Sleep Campaign, and others to sleep infants on their backs. While the practice demonstrably reduced the incidence of SIDS, placing infants in a supine position for sleeping has had the somewhat unforeseen and inadequately addressed increase in the number of infants developing what is commonly referred to as positional plagiocephaly.

In positional plagiocephaly, the relatively soft and deformable nature of a newborn infant's skull that is so critical during birth allows the skull to experience undesirable deformation. When an infant spends many hours daily sleeping exclusively on his or her back, the posterior portion of the skull tends to flatten. Similarly, when the child's head is routinely turned to one side, a cranial asymmetry where the affected side of the head shifts forward can develop over time. A further risk derives from so many babies spending a substantial portion of their day in some form of an infant seat, which, although padded, presents a relatively flat and inflexible support. With the back of the child's head resting on the support surface for extended periods of time, the infant seat can further contribute to positional plagiocephaly. If the consistent positioning of the head is continued through the critical period during which the bones of the skull become rigid, the flat or misshapen area on the back of the skull or elsewhere can become permanent.

A number of skilled inventors have attempted to provide arrangements for providing infants, children, and others with support and positioning assistance. However, the systems and methods of the prior art have typically not been easily adjustable to accommodate each person's size and condition. They have also commonly failed to be adaptable as a given child grows or develops different needs or goals. Even further, many prior art arrangements lack breathability and ventilation. This leaves many parents and caregivers worried about a child's ability to breath if his or her face becomes pressed against the support surface. The lack of breathability and ventilation in such support arrangements can also lead to discomfort and overheating for the occupant of the seat, bed, crib, or other support arrangement.

In light of the state of the art as summarized above, it will be appreciated that there is a need for a system for providing comfortable yet effective support and positioning assistance in a manner that can be readily varied and adjusted to accommodate persons of different sizes and needs. There is also a need for a system that readily allows variations in support and positioning to provide for optimal comfort, to promote development, and to enable a caregiver to vary the disposition of the occupant's body to prevent adverse physiological results. Still further, there is a need for a support system that can prevent positional plagiocephaly while providing breathability to improve comfort and to ensure that the occupant can breathe in an unobstructed manner even with his or her face against the support surface. A support and positioning system meeting these and further needs that the prior art has failed to meet would represent a notable advance in the field and a substantial benefit to persons needing the same and to their caregivers.

SUMMARY OF THE INVENTION

With an appreciation for the needs of infants, the challenges of those requiring support and positioning assistance, and the deficiencies left by the prior art, the present inventor set forth with the fundamental object of providing a support system that can provide comfortable yet effective support and positioning assistance to occupants of seats, beds, and other support structures.

A more particular object of embodiments of the invention is to provide a support system with repositionable bolsters that can adjust to accommodate differently sized persons and to permit varied and physiologically sound positioning of occupants.

A related object of embodiments of the invention is to provide a support system with repositionable bolsters to enable comfortable and effective support in varied configurations.

An additional object of embodiments of the invention is to provide a support system that provides resilient support and permits convenient repositioning of bolsters to prevent discomfort and to avoid positional plagiocephaly.

A further object of the invention is to provide a support system that fosters and encourages caregivers to offer infants supervised tummy time to promote healthy muscle and motor development.

In certain embodiments, a further object of the invention is to provide a support system with a framework that can be employed independently or in conjunction with a disparate support structure, such as a crib.

A still further object of particular embodiments of the invention is to provide a support system with an adjustable framework that can be adjusted between inclined and reclined dispositions.

Yet another object of certain embodiments of the invention is to provide an elastomeric support structure with repositionable bolsters that promotes healthy positioning and facilitates feeding.

Another object of embodiments of the invention is to provide a support system that provides ventilation and breathability thereby to improve comfort and to facilitate breathing even where an occupant has his or her face in contact with the bolster or support surface.

A related object of the invention is to provide an elastomeric support system that minimizes the risk of breathing difficulties of occupants.

These and in all likelihood further objects and advantages of the present invention will become obvious not only to one who reviews the present specification and drawings but also to those who have an opportunity to make use of an embodiment of the support structure with repositionable bolsters disclosed herein. Although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the invention, one most basic embodiment of the support system with repositionable bolsters is founded on a support frame that has a first portion, such as an edge, and a second portion, such as a second edge, spaced from the first portion. A panel of material, which can be an elastomeric material, is coupled to the support frame spanning from the first portion to the second portion. At least one bolster is provided with a means for being repositionably secured to the panel of elastomeric material. The frame can be foldable between a use configuration and a collapsed, storage configuration. The support system can be used independently, or the support frame can be coupled with or form a component of a wide variety of support structures including, by way of example, a crib, bassinet, car seat, high chair, swing, bouncing seat or support, or any other support structure.

Bolsters according to the invention can be formed with substantially any appropriate shape, size, and structure. In some manifestations of the invention, the bolsters can have body portions with a rigid core at least partially enveloped in a volume of padding. A shell, which can be a mesh or other fabric, plastic, leather, or any other material, can in turn envelop the volume of padding. Other bolsters can have a breathable material, such as a mesh fabric, enveloping a hollow skeleton.

The panel of elastomeric material can be stretched only between the first and second portions or across an entire periphery of the support frame. The panel of elastomeric material can have a plurality of interstitial apertures and can in some embodiments comprise a panel of elastomeric mesh. The panel of elastomeric material can be employed alone as a single support layer or in conjunction with one or more additional layers of support material, upholstery, padding, or the like. The support frame can be specifically designed and constructed to accommodate the panel of elastomeric material. The panel of elastomeric material can also be made to fit existing structures, such as by mimicking the structure of a fitted sheet to fit an existing mattress.

The means for repositionably securing the body portion of the bolster to the panel of elastomeric material can take many forms including those expressly disclosed herein and those that would be obvious to one skilled in the art after reading this disclosure. The securing means can take the form of at least one member for being received through an aperture in the panel of material, a means for adjusting the at least one member to secure it to the panel of material, and a means for readjusting the at least one member to release it from the panel of material.

For example, the securing means can take the form of a plurality of fingers with tips and rigid, arcuate body portions. The fingers can be adjustable, such as by operation of an actuation knob, from a retracted disposition to an extended disposition in relation to the body portion of the bolster. The tips of the fingers can follow an arcuate path during extension and retraction. With that, the tips and then the body portions of the fingers can be received through a first series of apertures in the panel of elastomeric material and possibly back through a second series of apertures spaced from the first series to secure the fingers and the bolster to the panel of elastomeric material. The fingers can be readjustable to the retracted disposition for releasing the fingers and the bolster from the panel of elastomeric material. With this, the bolster can be repositioned in effectively infinitely variable locations and orientations relative to the panel of elastomeric material and the support frame in general to provide tailored positioning support to an occupant.

In another example, the means for repositionably securing the body portion of the bolster to the panel of elastomeric material can comprise at least one expansible structure with a proximal portion and a distal portion that is adjustable from a non-expanded configuration to an expanded configuration, such as by operation of a button with a first position and a second position. With that, the expansible structure can be received through the apertures in the panel of elastomeric material and adjusted from a non-expanded configuration to an expanded configuration to secure the expansible structure and the bolster to the panel of elastomeric material and readjusted from the expanded configuration to the non-expanded configuration for releasing the expansible structure and the bolster from the panel of elastomeric material.

While numerous expansible structures are possible, one such structure is contemplated with a laterally moveable member, possibly a plurality of outwardly moveable members, and a means, such as a reciprocatable central member, for selectively moving the laterally moveable member or members laterally. Alternatively, the expansible structure can have a distal portion with an expandable bladder that can be selectively inflated by a means for inflating the bladder. In yet another embodiment, the means for repositionably securing the body portion of the bolster to the panel of elastomeric material can comprise at least one pair of arms. At least a portion of at least one of the pair of arms can be pivotably adjustable between a first disposition, such as where the arms are generally parallel, that allows the arms to be received through apertures in the panel of elastomeric material to a second disposition, such as where the arms are non-parallel, to secure the arms to the panel of elastomeric material. For example, each of the arms can have a distal portion that is pivotable from a generally parallel configuration to a crossed configuration to lock the bolster in place relative to the panel of elastomeric material.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

BRIEF DESCRIPTION OF THE DRAWINGS

The invention may be more completely understood with reference to the accompanying drawings, in which.

DETAILED DESCRIPTION OF PREFERRED EMBODIMENTS

As is the case with many inventions, the present invention for a support system with repositionable bolsters is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Before any particular embodiment of the invention is explained in detail, it must be made clear that the following details of construction and illustrations of inventive concepts are mere examples of the many possible manifestations of the invention.

Figure 1:
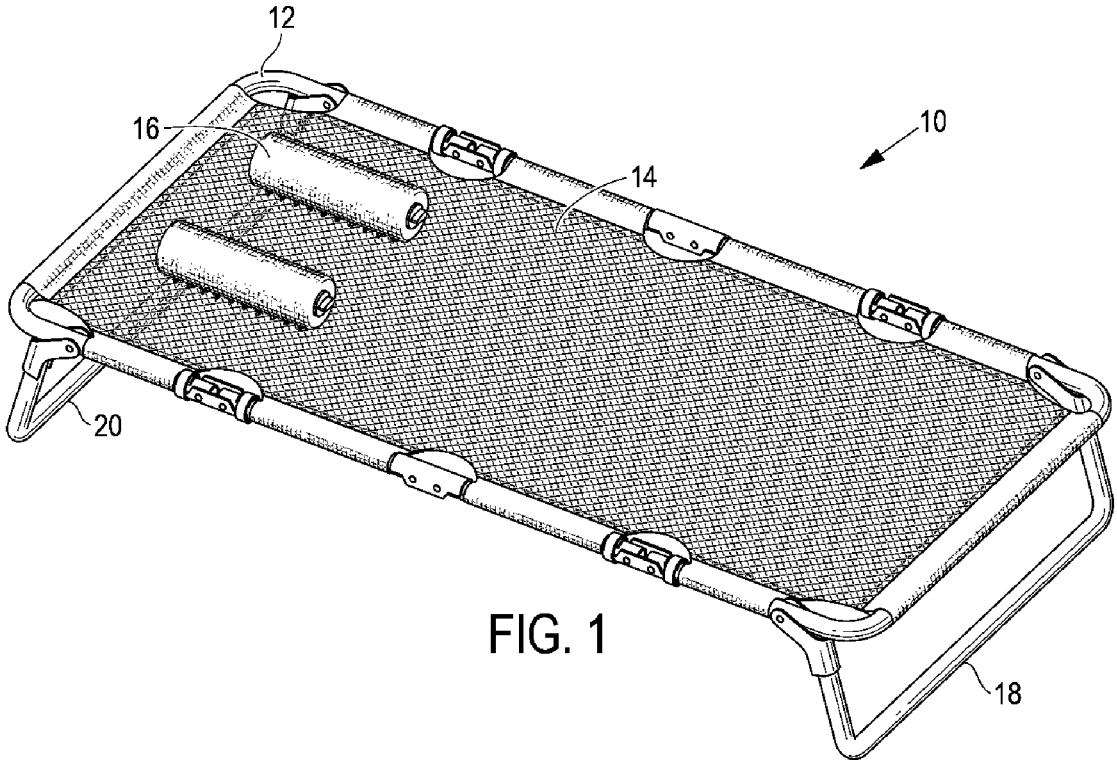
FIG. 1 is a partially sectioned perspective view of a support system with repositionable bolsters according to the present invention.

Turning more particularly to the drawings, a support system with repositionable bolsters according to the present invention is indicated generally at 10 in FIG. 1. There, the support system 10 is founded on a frame 12. In the depicted embodiment, the frame 12 is generally rectangular. Legs 18 and 20 are pivotably coupled to the frame 12 adjacent to first and second ends thereof. The frame 12 and the legs 18 and 20 can be formed from any suitable material, including plastic, wood, metal, rubber, fiberglass, or any combination thereof. A panel of material 14, which could comprise a permeable, elastomeric mesh or another resiliently stretchable material, spans the length and width of the frame 12 and is coupled along the periphery thereof. The panel of material 14 can be secured in any appropriate manner, including spline and groove, sleeves surrounding all or portions of the frame 12, staples, adhesive, or any other effective means for combination thereof.

Of course, one or more further layers of material can be used in combination with the panel of material 14. For example, padding or other added layers, whether above or below the panel of material 14, could be employed as necessary or helpful to providing comfortable and effective support. By means known in the art, tension in the panel of material 14 can be calibrated to provide effective support while preventing discomfort, positional plagiocephaly, and other deleterious characteristics of prior support systems. The panel of material 14 can be air permeable, particularly when formed from an elastomeric mesh, to permit effective breathing by an occupant even where his or her mouth and nose are in contact with the panel of material 14.

A plurality of bolsters 16 are secured to the panel of material 14 in a repositionable manner as is described more fully hereinbelow. In the depicted example, two bolsters 16 are shown. Of course, just one or multiple further bolsters 16, whether identical or differently shaped and constructed, may be employed. Bolsters 16 pursuant to the invention can generally be of any suitable shape, size, and construction. Where necessary or desirable, bolsters 16 can be substantially rigid over all or portions thereof. Alternatively, bolsters 16 can be quite soft over all or portions thereof. Preferably, the bolsters 16 will be formed with materials a configuration designed to be breathable to permit effective breathing even where an occupant has his or her face in close contact with the same.

Figure 10:
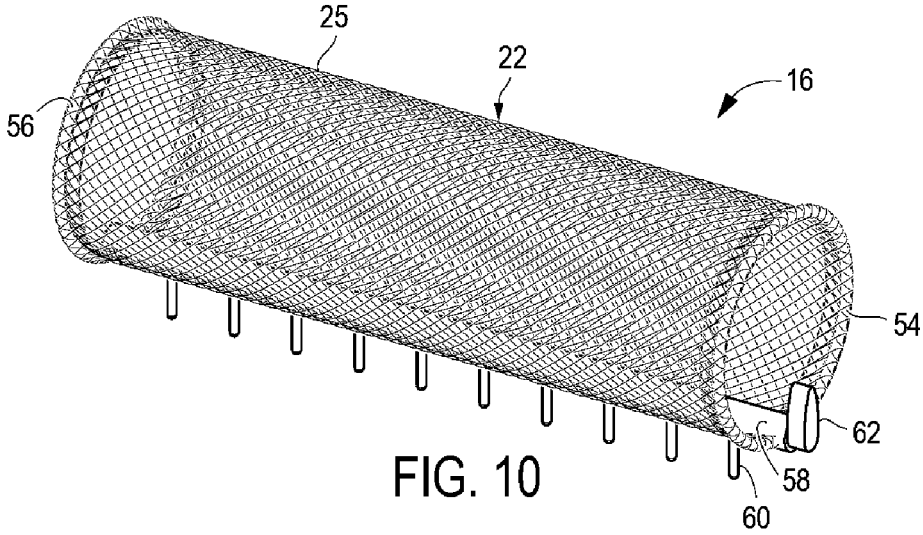
FIG. 10 is a perspective view of a further bolster according to the invention.

In one embodiment, which is depicted in FIG. 10, the bolster 16 can have a body portion 22 formed by a shell 25 of flexible material wrapped around and essentially conforming to a skeleton formed by spine 58 and first and second end members 54 and 56. Since the shell 25 will substantially conform to the outline defined by the first and second end members 54 and 56 and the spine 58, the body portion 22 of the bolster 16 can assume a wide variety of shapes by a manipulation of the shape of the skeleton. In FIG. 10, the first and second end members 54 and 56 comprise annular rings, and the spine 58 comprises an elongate, substantially straight structure. The spine 58 can be rigid. Alternatively, the spine 58 can be flexible, such as by being resiliently bendable or, perhaps more advantageously, by being of a shape memory material or structure to enable the shape of the spine 58 and the overall bolster 16 to be selectively adjusted.

The body portion 22 of the bolster 16 has a tubular shape with the shell 25 of flexible material potentially having an essentially hollow interior but for the spine 58 and the members 54 and 56. Where the flexible material forming the shell 25 is porous, as by being formed from an elastomeric mesh, the bolster 16 can present a fully breathable and vented surface to ensure that an occupant can experience comfortable breathing even where his or her face is pressed directly against the bolster 16.

Figure 3B:
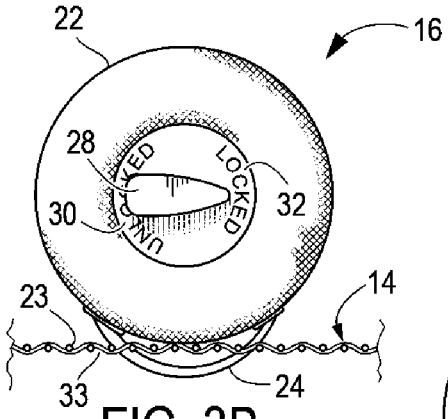
FIG. 3B is a view in front elevation of the bolster of FIG. 3A engaged with the panel of elastomeric mesh.
Figure 3A:
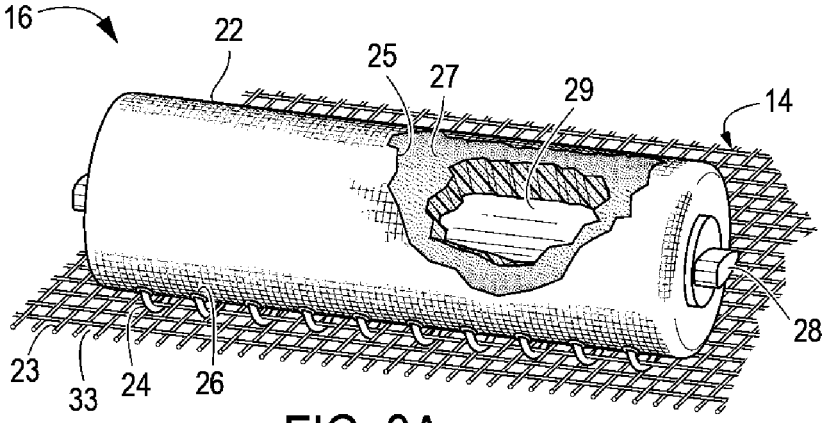
FIG. 3A is a perspective view from a first side of a bolster pursuant to the instant invention in proximity to a panel of elastomeric mesh.

In another example, as shown in FIG. 3A, the bolster 16 can have a body portion 22 with a core 29, which can be rigid, of plastic, wood, metal, rubber, or any other suitable material or combination thereof. The core 29 can be solid or hollow and annular, oval, or any other shape in cross section. The core 29 can be partially or completely enveloped in a volume of padding 27, which could comprise resiliently compressible foam, shape memory foam, or any other padding material or combination thereof. The core 29 and the padding 27 could be encased in a shell 25 of one or more layers of flexible material, which could comprise an elastomeric mesh for breathability, fabric, leather, plastic, or any other suitable material or materials.

Figure 2A:
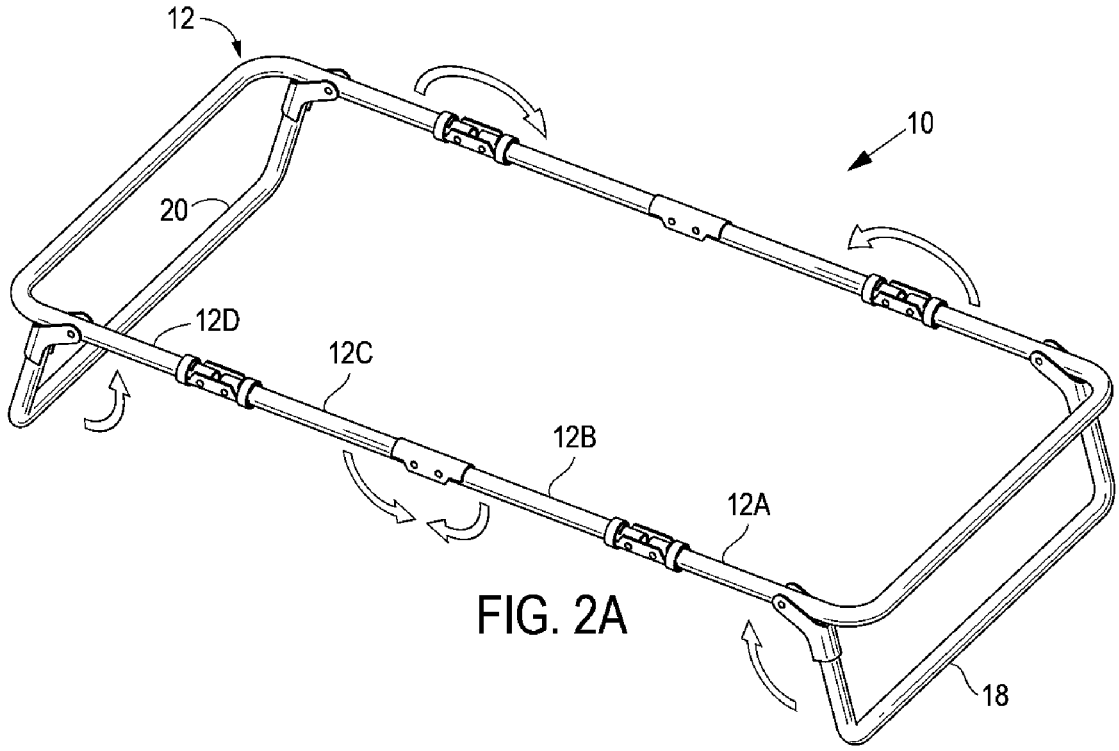
FIG. 2A is a perspective view of the support system of FIG. 1 devoid of its panel of material and in a use disposition.
Figure 2B:
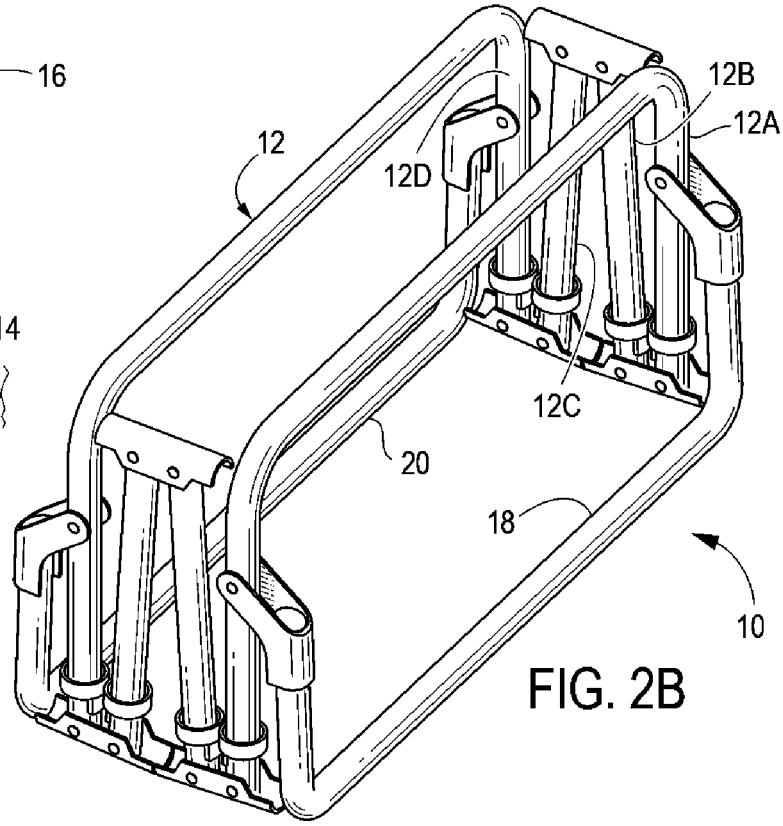
FIG. 2B is a perspective view of the support system of FIG. 1 again devoid of its panel of material and in a collapsed disposition.

As best perceived by combined reference to FIGS. 2A and 2B where the frame 12 is shown without the panel of material 14, the frame 12 can be collapsible from a use configuration, which is shown in FIG. 2A, and a collapsed configuration, which is shown in FIG. 2B. The frame 12 can have a first frame section 12A pivotally coupled to a second frame section 12B that is pivotally coupled to a third frame section 12C that is in turn pivotally coupled to a fourth frame section 12D. With this, the frame 12 can be unfolded to the use configuration for enabling the comfortable support of an occupant and to the collapsed configuration for storage and transportation.

Under the construction described above, the elastomeric support system 10 can be used to provide comfortable and nearly infinitely adjustable support and cushioning to an occupant by a selective placement and engagement of one or more bolsters 16 in relation to the panel of material 14. To accomplish this, the bolsters 16 can have a mechanism for being locked or secured in relation to the panel of material 14. Numerous potential locking mechanisms may be obvious to one skilled in the art after reading this disclosure, each being within the scope of the invention except as it may be expressly limited. A plurality of means for locking the bolster 16 in relation to the panel of material 14 are described below and shown in the accompanying drawings.

Figure 3C:
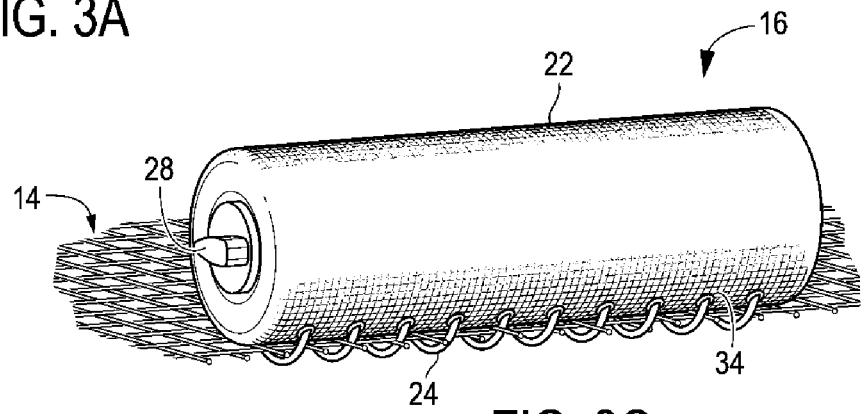
FIG. 3C is a perspective view from a second side of the bolster of FIG. 3A again engaged with the panel of elastomeric mesh.

Looking first to FIGS. 3A through 3C, a locking means is illustrated wherein a plurality of rigid fingers 24 with arcuate body portions project from apertures 26 in the body portion 22 of the bolster 16. The fingers 24 are disposed in a longitudinal row along the body portion 22 and have rounded tips for being received in a non-destructive manner through interstitial apertures 33 between threads 23 in the panel of material 14. As used herein, the terms threads and apertures should be given their broadest possible interpretation except as they may be expressly limited. Threads should be held to include any number of thin strands, cords, or filaments of natural or manufactured material. The term aperture should be interpreted to include any opening, such as a hole, gap, or slit, whether normally open or normally closed.

The fingers 24 can be selectively extended from the retracted position of FIG. 3A to the extended position of FIGS. 3B and 3C by a rotation of an actuation lever or knob 28 from an unlocked position 30 to a locked position 32. The tips of the fingers 24 follow an arcuate path such that they can pass through a first series of apertures 33 between the threads 23 in the panel of material 14, travel laterally, and then potentially pass back through a second series of apertures 33 between threads 23 in the panel of material 14 spaced from the first series of apertures 33. When fully extended, the fingers 24 can be received in reception apertures 34 in the body portion 22 for ensuring a safe and secure retention of the bolster 16.

The bolster 16 can be effectively locked in place in relation to the panel of material 14 and the frame 12 to provide positioning support to an occupant without imparting permanent deformation or damage to the panel of material 14. Just as importantly, the bolster 16 can be readily detached from the panel of material 14 by a counter-rotation of the actuation knob 28 to cause the body portions of the fingers 24 to be retracted through the apertures 33 in the panel of elastomeric material 14 and through the apertures 26.

With this, the number, positioning, and orientation of the bolsters 16 can be adjusted nearly infinitely. One or more bolsters 16 can be employed to accommodate varying positioning requirements, to adjust to occupants of differing sizes, shapes, and needs, and to adjust with the growth of a given occupant. Furthermore, when not used for body positioning, bolsters 16 can be positioned along one or more peripheral edges of the elastomeric material 14 and the frame 12 to act as a barrier to minimize the risk of an occupant's falling from the support system 10.

Figure 4A:
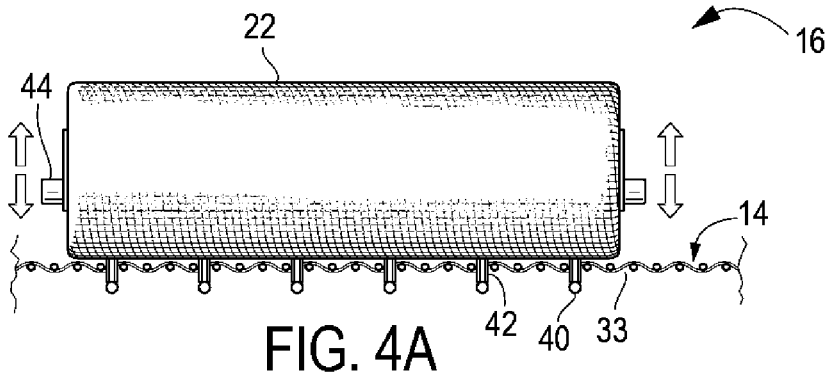
FIG. 4A is a view in side elevation of an alternative bolster according to the present invention shown not locked in relation to a panel of elastomeric mesh.
Figure 4B:
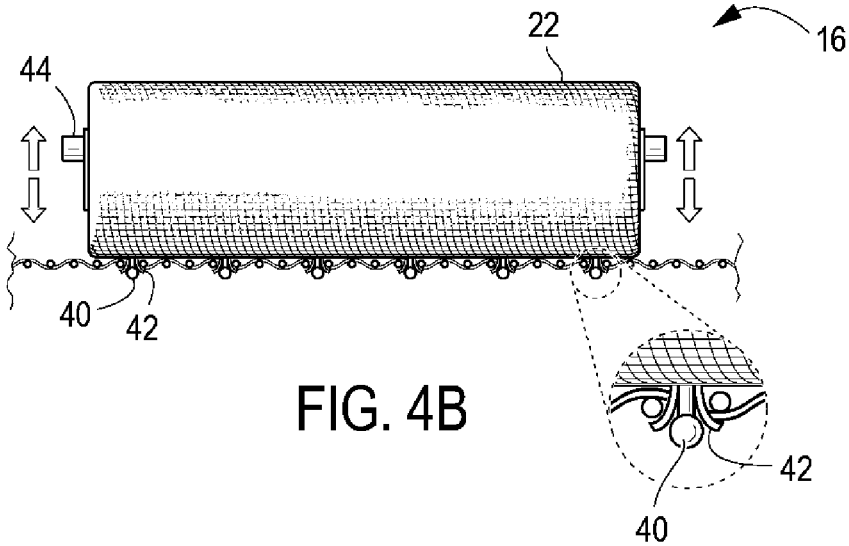
FIG. 4B is a view in side elevation of the bolster of FIG. 4A shown locked in relation to the panel of elastomeric mesh.

In other manifestations of the invention, bolsters 16 could be non-destructively retained relative to the panel of material 14 by one or more members sized to be received through apertures 33 in the panel of material 14, each with a distal portion capable of being expanded to lock the bolster 16 in place. In the example of FIGS. 4A and 4B, the bolster 16 can be selectively locked in place relative to a panel of material 14 by a plurality of expansible structures or expansion mechanisms formed by outwardly pivotable peripheral members 42 in combination with a reciprocatable central member 40. The expansible structures project radially from the body portion 16 of the bolster 22.

When in a closed configuration, the peripheral members 42 and the central member 40 are sized and configured to be passed through the apertures 33 in the panel of material 14. The reciprocatable central members 40 can be drawn toward the body portion 22 of the bolster 16 to cause the peripheral members 42 to spread apart thereby locking the bolster 16 in place relative to the panel of material 14 and extended away from the body portion 22 of the bolster 16 to permit the peripheral members 42 to draw together thereby to enable the bolster 16 to be removed from the panel of material 14 without damage thereto. The reciprocatable central members 40 can be actuated by slidable knobs 44 disposed at the first and second ends of the bolster 16 that can be slidable laterally to the body portion 22 and generally in line with the longitudinal movement of the central members 40.

With this, the bolster 16 can be locked in place in any location or orientation by pressing the central members 40 and the peripheral members 42 through apertures 33 in the panel of elastomeric material 14 and then sliding the knobs 44 thereby pulling the reciprocatable central members 40 toward the body portion to pivot the pivotable peripheral members 42 outwardly. When the bolster 16 is to be removed for repositioning, cleaning, storage, or the like, the knobs 44 can be oppositely slid to allow the peripheral members 42 to pivot together thereby to permit the central members 40 and the peripheral members 42 to be withdrawn from the apertures 33 in the panel of material 14.

Figure 5A:
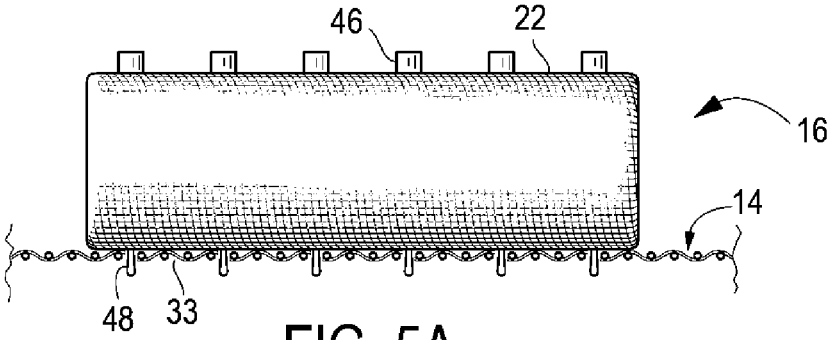
FIG. 5A is a view in side elevation of another bolster according to the invention disclosed herein shown not locked in relation to a panel of elastomeric mesh.
Figure 5B:
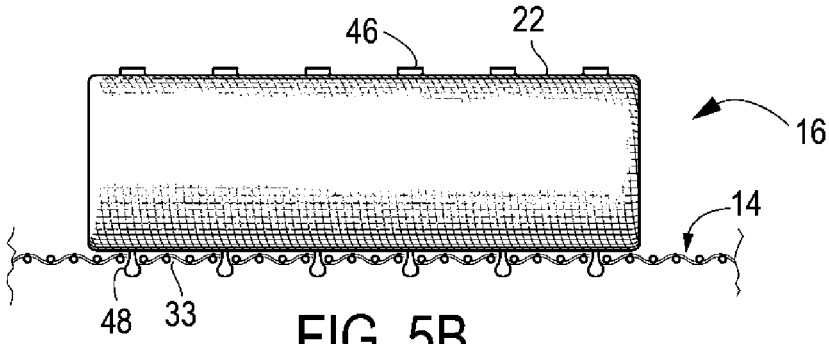
FIG. 5B is a view in side elevation of the bolster of FIG. 5A shown locked in relation to the panel of elastomeric mesh.

Looking to the embodiment of FIGS. 5A and 5B, the bolster 16 can be retained in relation to the panel of material 14 by a plurality of expandable members 48 that can project radially from the body portion 22 of the bolster 16. Each expandable member 48 has a body portion sized and shaped to be received through an aperture 33 in the panel of material 14. The body portions of the expandable members 48 can be expanded by operation of one or more buttons 46 that can cause distal portions, which can comprise fluid or otherwise expandable or inflatable bladders, of the expandable members 48 to adjust to an inflated or otherwise expanded disposition. With the distal portions of the expandable members 48 expanded distal to the panel of material 14, the bolster 16 is effectively secured in place. When the bolster 16 is to be removed for repositioning, storage, or the like, the buttons 46 can be de-actuated thereby to permit the expandable members 48 to be readjusted by compressing to allow them to be withdrawn from the apertures 33 in the panel of material 14.

Figure 6A:
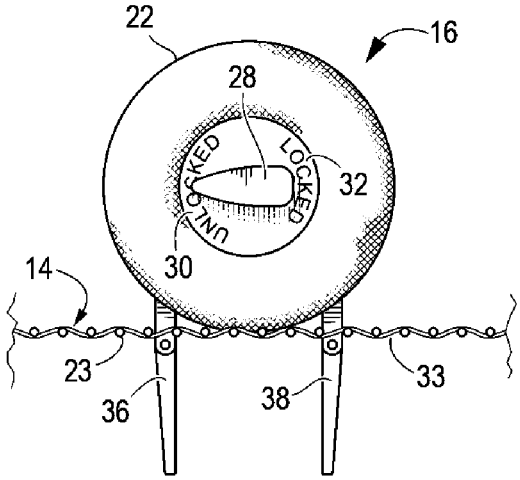
FIG. 6A is a view in front elevation of yet another bolster according to the invention shown not locked in relation to a panel of elastomeric mesh.
Figure 6B:
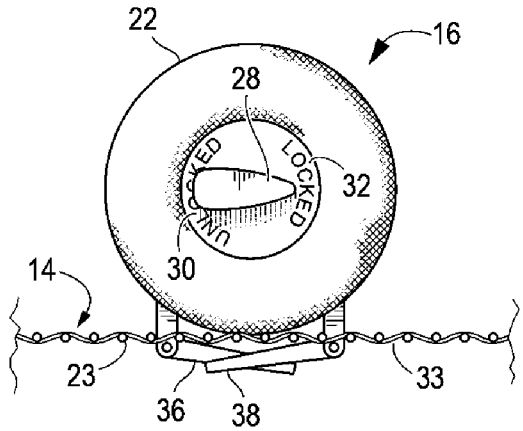
FIG. 6B is a view in front elevation of the bolster of FIG. 6A shown locked in relation to the panel of elastomeric mesh.

Another alternative means for removably and replaceably securing the bolster 16 to the panel of material 14 is shown in FIGS. 6A and 6B. There, arms 36 and 38 project from the body portion 22 of the bolster 16. Each arm 36 and 38 has a fixed proximal portion and a pivoting distal portion. The distal portions of the arms 36 and 38 can be adjusted by pivoting between the generally parallel disposition shown in FIG. 6A and the non-parallel, in this case crossed, configuration shown in FIG. 6B. Pivoting of the distal portions of the arms 36 and 38 can be controlled by an actuation knob 28 that can be rotated between an unlocked position 30 and a locked position 32.

Under this arrangement, the bolster 16 can be engaged in any position and orientation with a panel of material 14 with apertures 33 therein by passing the distal portions of the arms 36 and 38 through apertures 33 in the panel of material 14 while the arms 36 and 38 are in a generally parallel disposition. Then, the distal portions of the arms 36 and 38 can be pivoted to the crossed configuration by a rotation of the knob 28 thereby locking the bolster 16 in place relative to the panel of material 14. When necessary, the bolster 16 can be removed from the panel of material 14 by adjusting the distal portions of the arms 36 and 38 to a parallel orientation, again by operation of the knob 28, and sliding them from the apertures 33. The bolster 16 can then be repositioned with no damage to the panel of material 14.

Similarly, the bolster 16 in FIG. 10 can be secured to a panel of material 14 by a plurality of arms 60, which again can be articulated. The arms 60 can be disposed in a longitudinally aligned row projecting radially from the body portion 22. By operation of a knob or lever 62, distal portions of the arms 60 can pivot to skewed disposition, such as orthogonal to a radius of the body portion 22. With this, the bolster 16 can be secured to a panel of porous material by inserting the arms 60 through apertures in the material and then actuating the arms 60 by operation of the lever 62. The bolster 16 can be released from the panel of material by an opposite actuation of the lever 62 to bring the arms 60 to a straight disposition thereby enabling them to be withdrawn from the apertures in the material.

Figure 7:
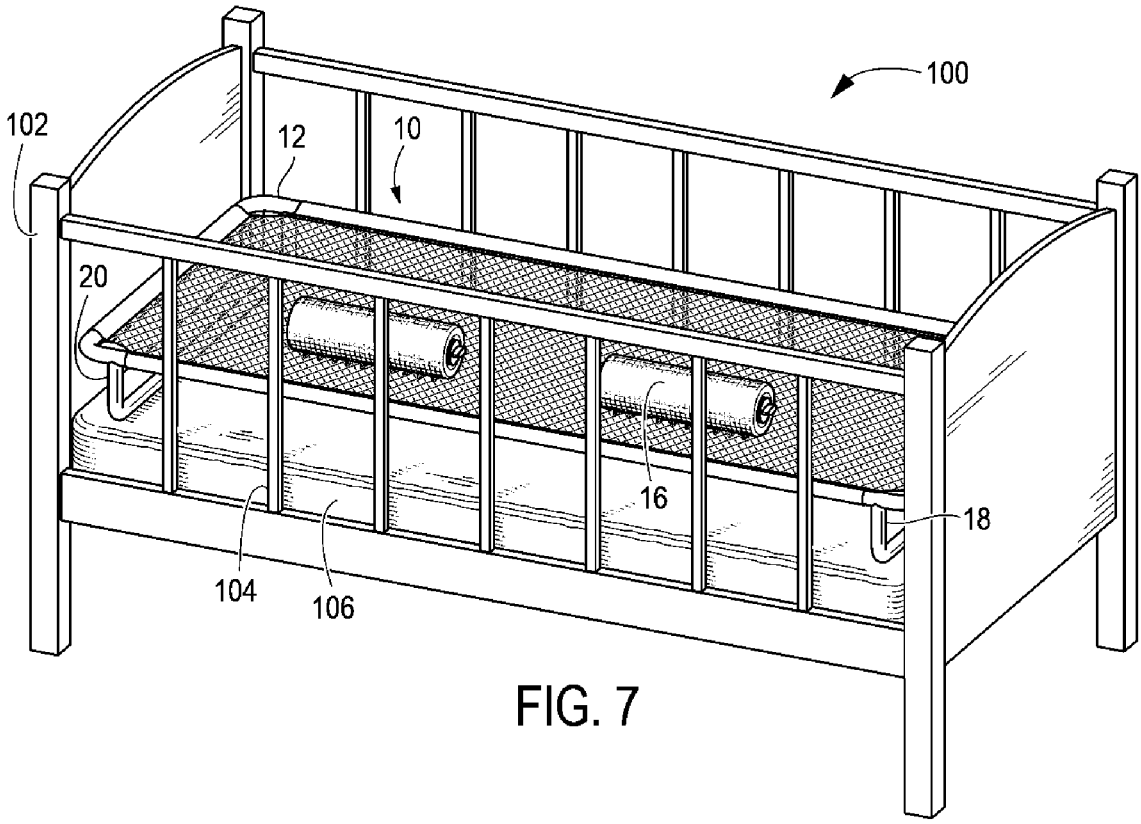
FIG. 7 is a perspective view of a support system pursuant to the invention disposed within a crib.

Embodiments of the support system 10 can be employed independently to provide comfortable support and readily adjustable positioning assistance to an occupant. However, it is also within the scope of the invention for the support system 10 to provide support atop or within a larger structure. For example, as shown in FIG. 7, the support system 10 can be disposed within a crib 100 without or atop the mattress 106 within the frame 102 and the rails 104. The panel of material 14 can be retained spaced from the mattress 106 or from the base of the crib 100 by the legs 18 and 20. One or more bolsters 16 can be secured to the panel of material 14 by any effective means for non-destructively retaining the bolsters 16 in place, including the particular means disclosed herein. With this, a child lying in the crib 100 or merely on a support system 10 employed independently, such as on a floor or other surface, can be provided with comfortable support and positioning assistance on a breathable support surface that prevents positional plagiocephaly and permits effective breathing.

Figure 8:
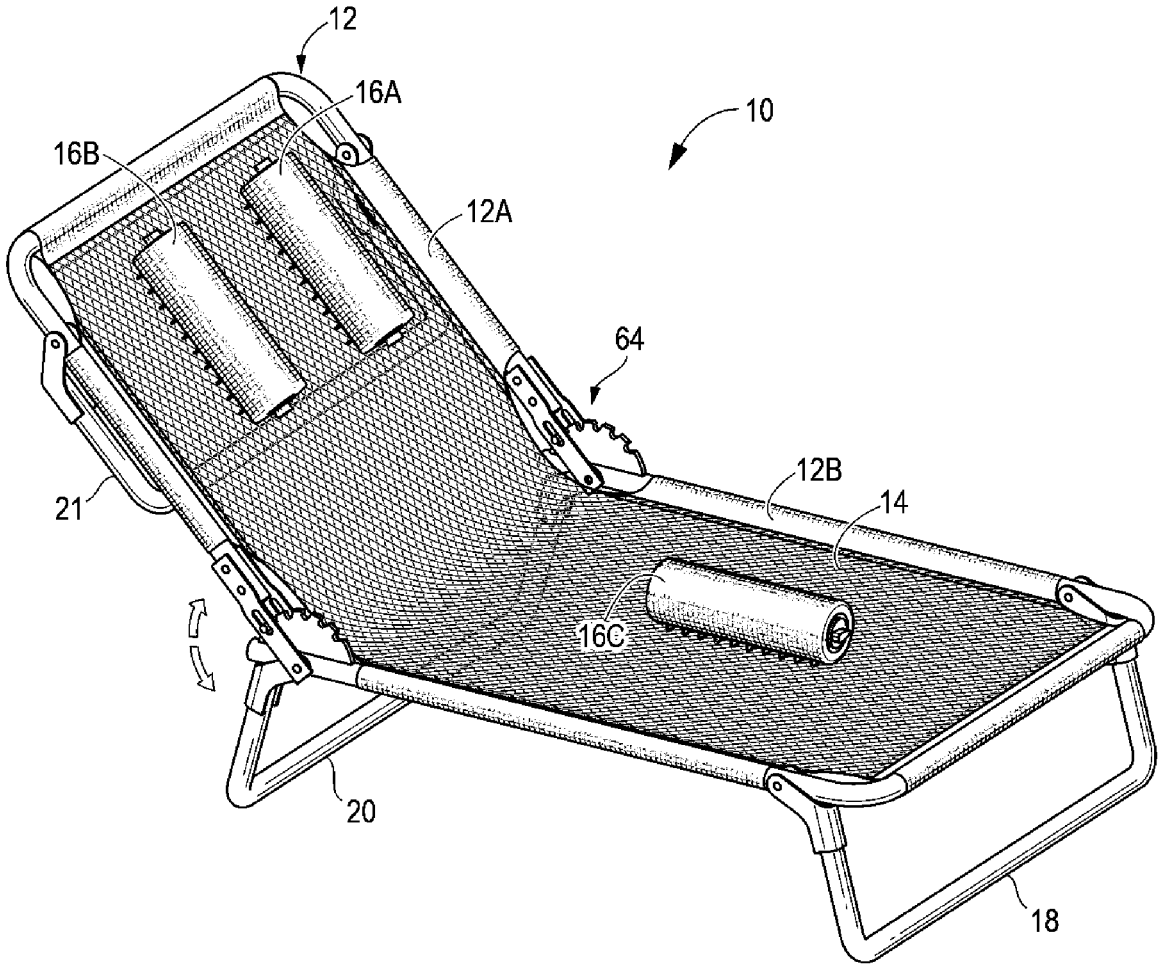
FIG. 8 is a perspective view a support system with repositionable bolsters embodied in a bassinet.

Within the scope of the invention, the support system 10 can take forms other than the rectangular construction of, for example, FIG. 1. As shown in FIG. 8, the support system 10 can take the form of a bassinet with a correspondingly configured frame 12. The frame 12 can have a back frame portion 12A coupled to a base frame portion 12B by a selectively locking hinge connection 64 for retaining the back frame portion 12A of the support system 10 at varying angles. First, second, and third support legs 18, 20, and 21 can support the support system 10 in relation to a surface, such as a floor, table, or the like. A plurality of bolsters 16A, 16B, and 16C are selectively coupled to the panel of material 14, which again can be elastomeric mesh, with the bolsters 16A and 16B disposed to provide head support and the bolster 16C is positioned to provide support between an occupant's legs.

Figure 9:
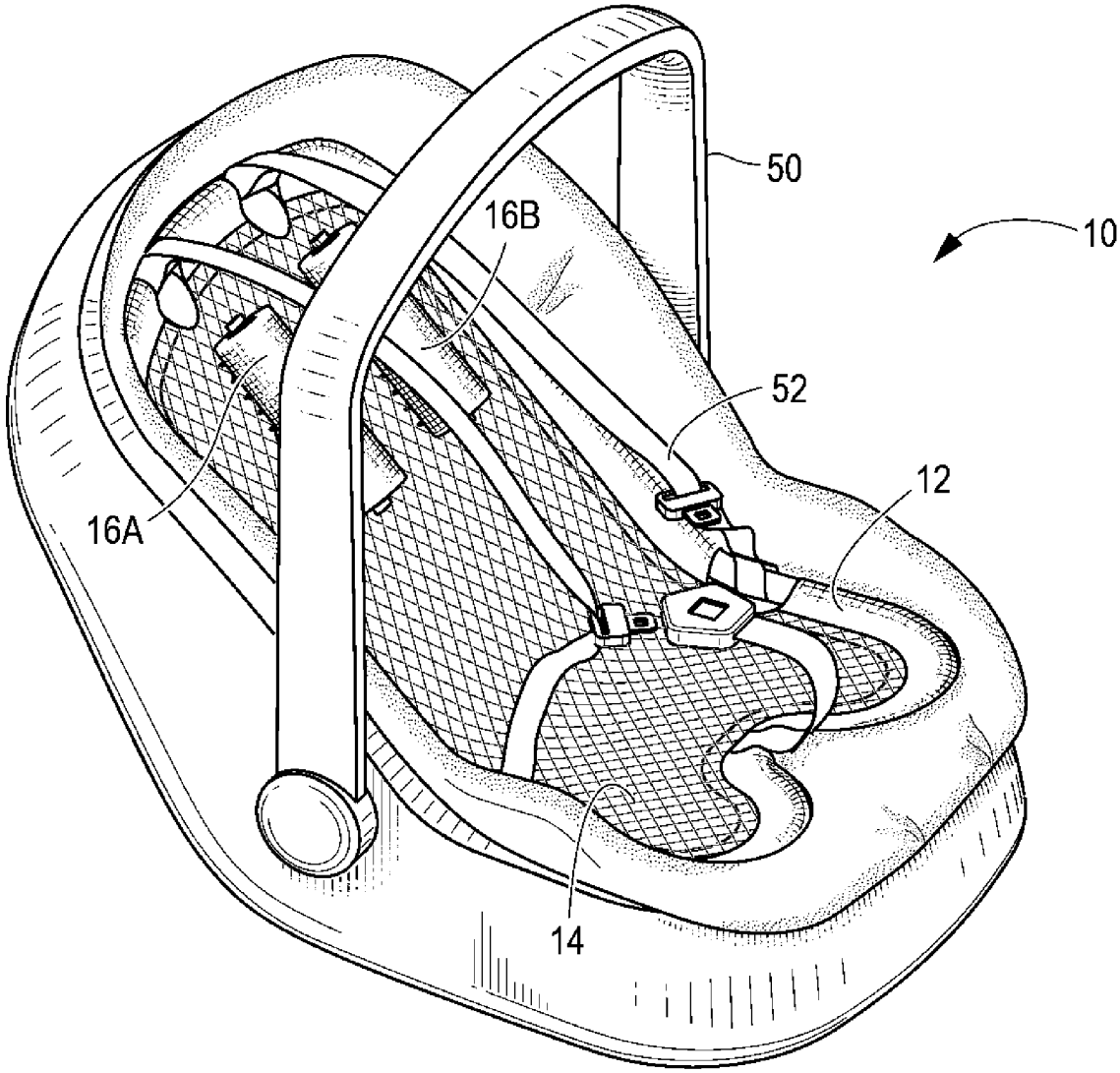
FIG. 9 is a view in front elevation of a support system with repositionable bolsters embodied in an infant carrier.

Still another embodiment of the invention is shown in FIG. 9 where the support system 10 takes the form of a child carrier seat. As such, the support system 10 has a shell frame 12. A panel of elastomeric material 14 spans across the shell frame 12 for providing support to an occupant. Straps 52 are provided for securing the infant or other occupant in place, and a pivoting handle 50 enables the support system 10 to be lifted and carried. Bolsters 16A and 16B can be selectively positioned depending on the needs, size, and other characteristics of the occupant. In the depicted examples, the bolsters 16A and 16B are positioned to provide head support.

Figure 11:
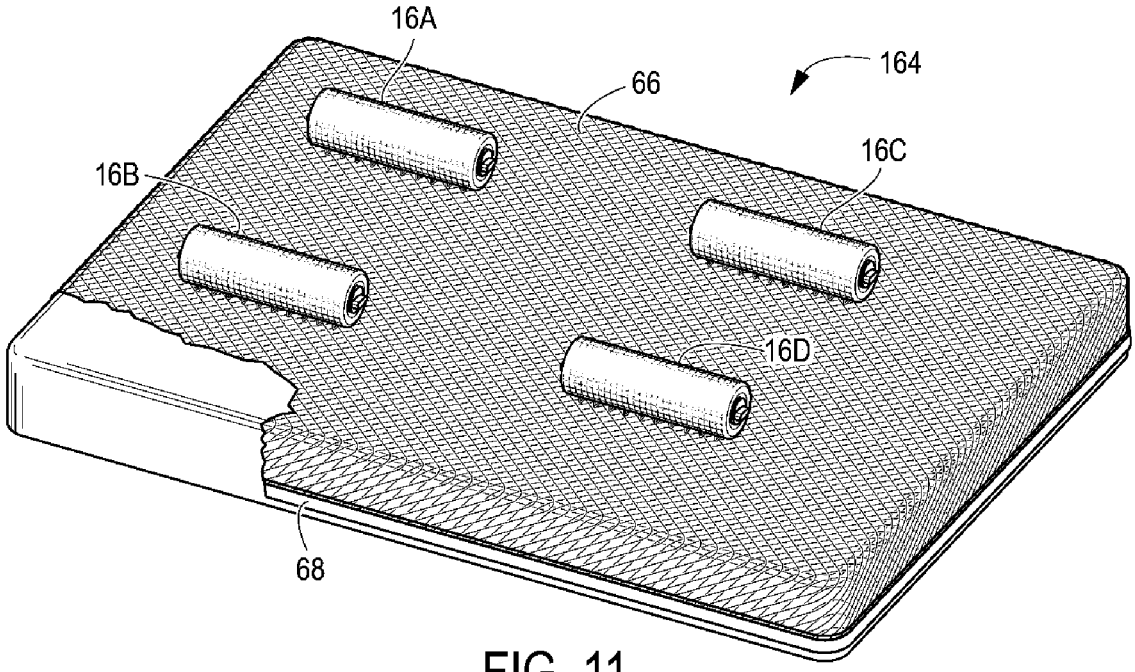
FIG. 11 is a perspective view of another support system as taught herein.

It is contemplated within the scope of the invention for panels of material to be fitted around or on pre-existing support surfaces, such as a bed, couch, or the like (not shown). One way of accomplishing such a goal would be by use of a flexible body 66 of material with a means for securing the same to the external support structure, such as straps, hook and loop material, or by being fitted as shown in FIG. 11. With that, the body 66 of material can resemble in shape a fitted bed sheet with a flat panel and sides and a resilient band 68 along some or all of the edge thereof. The body 66 of material can be fitted over a bed or couch and retained securely in place. Some or all of the material forming the body 66 can have apertures therein, such as by being formed from an elastomeric mesh. With that, one or more bolsters 16 can be selectively retained relative to the body 66 and thus relative to the bed, couch, or other structure in substantially any position and orientation to provide selective positioning support to an occupant. In FIG. 11, for example, four bolsters 16A, 16B, 16C, and 16D are applied to the body 66. The bolsters 16A through 16D can have any shape, whether tubular, rectangular, or otherwise shaped. Such an embodiment can be useful for any occupant and may be particularly useful for those temporarily needing support, such as pregnant women, injured persons, or persons recovering from surgery.

The disclosed support system 10 thus provides a plurality of advantages over the known prior art. By way of example, the support system 10 can enable an infant to be comfortably supported in varied positions by a resilient, breathable support surface thereby preventing positional plagiocephaly and permitting effective breathing without regard to the infant's body position. Depending on the embodiment of the invention, the infant can be easily repositioned, including by use of supportive bolsters 16, throughout a day from laying on his or her side, back, tummy, reclined, or sitting while complying with the Back to Sleep Campaign. By providing an air permeable panel of material 14, the support system 10 encourages caregivers to offer infants regular supervised tummy time thereby promoting healthy muscular and motor development. With infinitely repositionable bolsters 16, the support system 10 can provide tailored and adaptive support and positioning of infants and individuals with special needs during eating and other tasks. Embodiments of the support system 10 can be readily collapsed for storage and transportation. The support system 10 can be used in creating a fixed-configuration or portable crib, or it can be incorporated within pre-existing portable or fixed-configuration cribs, bassinets, car seats, high chairs, swings, bouncing seats or supports, or any other support structures.

With certain details of the present invention for a support structure with repositionable bolsters disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims express certain elements as means for performing a specific function, at times without the recital of structure or material. As the law demands, these claims shall be construed to cover not only the corresponding structure and material expressly described in this specification but also all equivalents thereof that might be now known or hereafter discovered.

I claim as deserving the protection of Letters Patent:

1. A support system with repositionable bolsters comprising:

a panel of material comprising a plurality of interstitial apertures retained to form a support surface;

at least one bolster with a body portion and a means for repositionably securing the body portion relative to the panel of material comprising at least member for being received through an aperture in the panel of material, a means for adjusting the at least one member to secure the at least one member to the panel of material, and a means for readjusting the at least one member to release the at least one member from the panel of material.

2. The support system with repositionable bolsters of claim 1 further comprising a support frame with a first portion and a second portion spaced from the first portion wherein the panel of material is coupled to the support frame spanning from the first portion of the support frame to the second portion of the support frame and wherein the frame is foldable between a use configuration and a collapsed, storage configuration.

3. The support system with repositionable bolsters of claim 1 wherein the body portion of the bolster comprises a skeleton and a shell of flexible, porous material wrapped around the skeleton to define an open inner volume.

4. The support system with repositionable bolsters of claim 3 wherein the shell of flexible, porous material comprises a mesh and wherein the open inner volume is substantially hollow.

5. The support system with repositionable bolsters of claim 1 wherein the body portion of the at least one bolster has a core at least partially enveloped in a volume of padding.

6. The support system with repositionable bolsters of claim 1 wherein the panel of material comprises an elastomeric mesh.

7. The support system with repositionable bolsters of claim 6 further comprising a support frame with a first portion and a second portion spaced from the first portion wherein the panel of material is coupled to the support frame spanning from the first portion of the support frame to the second portion of the support frame and wherein only the panel of material spans from the first portion of the support frame to the second portion of the support frame.

8. The support system with repositionable bolsters of claim 1 wherein the means for repositionably securing the body portion of the bolster to the panel of material comprises a plurality of fingers with tips and rigid, arcuate body portions and wherein the fingers are adjustable from a retracted disposition to an extended disposition in relation to the body portion of the bolster for being received through the apertures in the panel of material to secure the fingers and the bolster to the panel of elastomeric material and wherein the fingers are readjustable to the retracted disposition for releasing the fingers and the bolster from the panel of material.

9. The support system with repositionable bolsters of claim 8 wherein the plurality of fingers are adjustable and readjustable by operation of an actuation member retained relative to the body portion of the bolster.

10. The support system with repositionable bolsters of claim 8 wherein the tips of the fingers follow an arcuate path such that they can pass through a first series of apertures in the panel of material and travel laterally to secure the fingers and the bolster to the panel of material.

11. The support system with repositionable bolsters of claim 1 wherein the means for repositionably securing the body portion of the bolster to the panel of material comprises at least one expansible structure for being received through the apertures in the panel of material wherein the at least one member has a proximal portion and a distal portion wherein the distal portion is adjustable from a non-expanded configuration to an expanded configuration to secure the expansible structure and the bolster to the panel of material and wherein the distal portion is readjustable from the expanded configuration to the non-expanded configuration for releasing the expansible structure and the bolster from the panel of material.

12. The support system with repositionable bolsters of claim 11 wherein the expansible structure comprises at least one laterally moveable member and a means for selectively moving the laterally moveable member laterally.

13. The support system with repositionable bolsters of claim 12 wherein the expansible structure comprises a reciprocatable central member in combination with a plurality of outwardly moveable peripheral members and a means for reciprocating the reciprocatable central member to adjust the peripheral members between an open configuration and a closed configuration.

14. The support system with repositionable bolsters of claim 11 wherein the at least one expansible structure has a distal portion with an expandable bladder and further comprising a means for inflating the bladder.

15. The support system with repositionable bolsters of claim 14 wherein the means for inflating the bladder comprises a button adjustable between a first position wherein the bladder is inflated and a second position wherein the bladder is deflated.

16. The support system with repositionable bolsters of claim 1 wherein the means for repositionably securing the body portion of the bolster to the panel of material comprises at least one pair of arms wherein at least a portion of at least one of the pair of arms is pivotably adjustable between a first disposition wherein the arms can be received through apertures in the panel of material to a second disposition wherein the arms are secured to the panel of material.

17. The support system with repositionable bolsters of claim 16 wherein each arm of the at least one pair of arms has at least a portion thereof pivotably adjustable from the first disposition to the second disposition.

18. The support system with repositionable bolsters of claim 17 wherein at least a portion of each arm of the at least one pair of arms is pivotably adjustable from a generally parallel disposition to a non-parallel disposition.

19. The support system with repositionable bolsters of claim 1 further comprising a support frame with a first portion and a second portion spaced from the first portion wherein the panel of material is coupled to the support frame spanning from the first portion of the support frame to the second portion of the support frame and wherein the support frame is generally rectangular and further comprising at least first and second legs coupled to the support frame for supporting the support frame above a surface.

20. The support system with repositionable bolsters of claim 1 further comprising a support frame with a first portion and a second portion spaced from the first portion wherein the panel of material is coupled to the support frame spanning from the first portion of the support frame to the second portion of the support frame and wherein the support frame comprises a bassinet frame with a back frame portion pivotably coupled to a base frame portion.

21. The support system with repositionable bolsters of claim 1 further comprising a support frame with a first portion and a second portion spaced from the first portion wherein the panel of material is coupled to the support frame spanning from the first portion of the support frame to the second portion of the support frame and wherein the support frame comprises a child carrier seat frame and further comprising straps coupled to the support frame for securing an occupant in place.

22. The support system with repositionable bolsters of claim 1 wherein the panel of material has a plurality of interstitial apertures and further comprising an elasticized portion disposed along at least a portion of an edge of the panel of material for retaining the panel of material relative to an external support structure and wherein the means for repositionably securing the body portion relative to the panel of material comprises a means for engaging the apertures in the panel of material.

* * * * *